US005845344A

United States Patent [19]

Lenighan

[11] Patent Number: 5,845,344

[45] Date of Patent: Dec. 8, 1998

[54] BATH AND SHOWER COMBINATIONS

[76] Inventor: Jeremy David Lenighan, 131 Dewsbury Road, Leeds West Yorkshire L211 5NN, Great Britain

[21] Appl. No.: 836,828

[22] PCT Filed: Nov. 21, 1995

[86] PCT No.: PCT/GB95/02717

§ 371 Date: May 20, 1997

§ 102(e) Date: May 20, 1997

[87] PCT Pub. No.: WO96/15707

PCT Pub. Date: May 30, 1996

[30] Foreign Application Priority Data

Nov. 21, 1994 [GB] United Kingdom ..... 9423451

[51] Int. Cl.[6] ..... A47K 3/08

[52] U.S. Cl. ..... 4/557; 4/559; 4/607

[58] Field of Search ..... 4/557, 558, 559, 4/607, 608, 605

[56] References Cited

U.S. PATENT DOCUMENTS

| | | | |
|---|---|---|---|
| 1,664,491 | 4/1928 | Siegel | 4/557 |
| 2,048,909 | 7/1936 | Woodworth | 4/557 |
| 3,500,481 | 3/1970 | McKwane . | |
| 3,896,508 | 7/1975 | Doan . | |
| 4,542,545 | 9/1985 | Johnson et al. | 4/557 |
| 4,903,433 | 2/1990 | Baus . | |
| 4,974,269 | 12/1990 | Baus . | |
| 5,097,543 | 3/1992 | Oille | 4/557 |

FOREIGN PATENT DOCUMENTS

| | | | |
|---|---|---|---|
| 0204321 | 12/1986 | European Pat. Off. | A47K 3/22 |
| 0 389 000 | 9/1990 | European Pat. Off. | A47K 3/22 |
| 2462091 | 1/1974 | Germany | A47K 3/22 |
| 2901371 | 7/1980 | Germany | E06B 3/48 |
| WO 85/02099 | 5/1985 | WIPO | A47K 3/22 |

*Primary Examiner*—David J. Walczak
*Attorney, Agent, or Firm*—Zarley, McKee, Thomte, Voorhees & Sease

[57] ABSTRACT

The invention provides that a bath has one or more shoulders which receives or receive the lower edges of one or more shower screen panels which forms or form a means preventing water from passing over the side of the bath. The shoulder or shoulders is or are formed by distinct steps on the insides of the bath, at the top edge thereof, so that the upright side face or faces of the shoulder or shoulders form an obstruction preventing the panel or panels from swinging out beyond the sides of the bath. The said panel or panels preferably are adapted to be supported through seal means on said shoulders when in use so that the shoulder effectively shed shower water back into the bath and preferably there are two groups of panels defining front and transverse sections of a shower cubicle over the bath, the panels of each group being suspended from the ceiling of the bathroom and being hinged together so as to be capable of being folded concertina fashion to lie parallel to each other and to an adjacent bathroom wall in a stowed position.

7 Claims, 2 Drawing Sheets

II
B
10
20
12
16
14
29
32B
32C
28B
18
24
26
28
28A
A

BATH AND SHOWER COMBINATIONS

It is well known and widely practised to fit a shower over a bath in a bathroom in order that a user of the bathroom can take a shower by standing in the bath and turning the shower on. In such circumstances, however it is necessary to provide some sort of screen or curtain to prevent the shower water from overspilling the edge of the bath and for ensuring that the shower water drains back into the bath well and out of the drain hole in the bath.

The simplest method of providing a shower arrangement over a bath is to suspend a curtain of waterproof material from the ceiling and so as to hang down into the bath. Whilst this arrangement does function, it is extremely unsatisfactory, and because of the flexible nature of the curtain, it tends to billow and move under the air induction effect created by the flowing shower. It also becomes wet and needs to be taken down to be cleaned by laundering. When wet it tends to cling to the inner side of the bath, and in general it is not particularly satisfactory.

Other arrangements have involved the provision of rigid, front shower panels which are much more aesthetically pleasing than a shower curtain.

These bath panels may either be fixed or movable. Fixed panels are mounted on the top edge of the bath and extend to a suitable height above the bath but they have the disadvantage that cleaning of the bath is difficult and entry to the bath is also awkward because the user has to enter the bath from the end remote from that end where the shower is positioned. The shower is usually positioned at the drain plug end of the bath, and the other end of the bath is provided with a sloping face which means that entry is difficult.

The movable rigid bath panels provide a solution to these difficulties, and these panels can be stacked by folding or sliding and may be hinged away to a stored position in which they lie parallel to the adjacent walls of the bathroom when they are not in use. When the shower is to be used, the user can enter the bath and then position the panels accordingly prior to the taking of a shower.

In each case, the bath panels stand on the top edge of the bath, and although some attempts are made at forming a seal between these panels which stand on the side of the bath, invariably there is still leakage of water past the underside of the panels and over the edge of the bath onto the floor in the bathroom. It is also known to provide end or ancillary panels which extend across the bath and co-operate with the front panels to form a shower enclosure, these end panels being provided in cases where mains pressure showers are provided (the extent of use of mains pressure showers is increasing rapidly in view of recent legislation allowing stored water at mains pressure and combination systems).

Various bath/shower screen combinations are shown in the following patent specifications.

British Patent Application No 2264233A in the name of David Howarth

U.S. Pat. No. 5,123,129

International Patent Application No WO85/02099 in the name of Hooper GmbH

European Patent Application No 0204321 in the name of Hooper GmbH

The idea in the Howarth specification is that the screen should be capable of swinging over the edge of the bath to an outwards position. It is furthermore movable to a stored position along another part of the bath and between the stored and operational positions the screen does not experience any up and down movement. It is imperative that a lower edge on the screen is movable to and away from the upper edge of the bath to enable the outward swinging to take place.

As regards U.S. Pat. No. 5,123,129, this is concerned simply with a deflector skirt on the bottom of the bath panels.

In the International application, the disclosure concerns the formation of a cage above the bath, and the panels forming the cage being notched so as to sit part on the top of the bath and part on the inner edge.

As far as the European application is concerned, the panels overhang the inside of the bath, and therefore they cannot be swung outwardly, but they hang freely to the inside of the bath.

The present invention seeks in its general aspect to provide a simple and effective means for providing an effective over the bath shower screen arrangement which is more effective than the known screen panels in providing for effective drainage of the shower water back into the bath and not onto the bathroom floor.

In accordance with the invention in a general aspect, a bath and shower screen assembly wherein the shower screen 28 comprises a single front panel or two or more front panels hinged together, and wherein the shower screen 28 is pivotally mounted relative to the bath 10, so that the screen can be swung from an in use position in which it is over the front side 22 of the bath 10 but is prevented from being swung outwards over said front side 22, and prevents water from a shower from spilling over said front side 22 of the bath 10, and a stowed position in which the screen is clear of said front side 22, and wherein the front side of the bath 10, at least in the location of the bottom of the screen 28 when it is in the in use position, is internally stepped and defines a shoulder 36, characterised in that the shoulder is engaged by the bottom edge of the screen 28 in the in use position, so as to hold the screen 28 in said in use position.

The invention provides a number of advantages namely that the shower water drains effectively back into the bath and not onto the top edge of the bath (and possibly onto the bathroom floor), and also that lateral loading on the panel or panels does not result in the panel or panels from being displaced over the side edge of the bath, a fault which exists with the conventional arrangements wherein the rigid panels are mounted on the top edge of the bath, and that the screen is held in position by engagement with the shoulder when in the in use position.

Preferably the said lower edge will be provided with a sealing strip which frictionally engages the shoulder defined by the step on the inside of the bath, enhancing the sealing effect between the lower end of the panel or panels and the bath surface.

The sealing strip also serves to hold the panels in position.

Any number of front panels may be provided for defining the shower screen along the side of the bath, and these panels may be fixed but preferably are displacable to an out of use position parallel to an adjacent bathroom wall.

There may also be an end or transverse panel or panels the bottom edge or edges of which can be located in a similar step in the bath top edge at the other side of the bath. The transverse assembly may also be movable between a stored position in which it lies parallel to an adjacent bathroom wall, and transverse position in which it extends across the bath. Its outer most bottom corner may well be adapted to engage in the step at the other side of the bath which houses the front of the panel assembly, providing enhanced sealing effect.

In both cases the screens are hinged to the walls, or alternatively each screen may be supported hingedly on the adjacent wall. When it is in the in use position, the bottom edge or edges of the screen panel or panels are supported on the shoulder of the step formed in the bath.

The said shoulder or step may be formed along the length of the bath only sufficient to accommodate the screen assembly, and similarly at the other side of the bath the step may be of a length only sufficient to accommodate the transverse screen assembly when in the stored position. The shoulder or step can however be of any length and can extend completely round the bath or along all of each side of the bath.

In a particular configuration, where the bath is generally rectangular in plan, the taps may be provided at one corner and the adjacent long side of the bath extending from that corner may be provided with the step to accommodate the transverse screen, and the adjacent short edge and the other long edge provided with a step to accommodate the side screen. The adjacent short edge and the adjacent long edge preferably are arranged to be butted against bathroom walls in a bathroom corner.

One embodiment of the invention will now be described, by way of example, with reference to the accompanying diagrammatic drawings, wherein.

Figures 1, 4, 5:
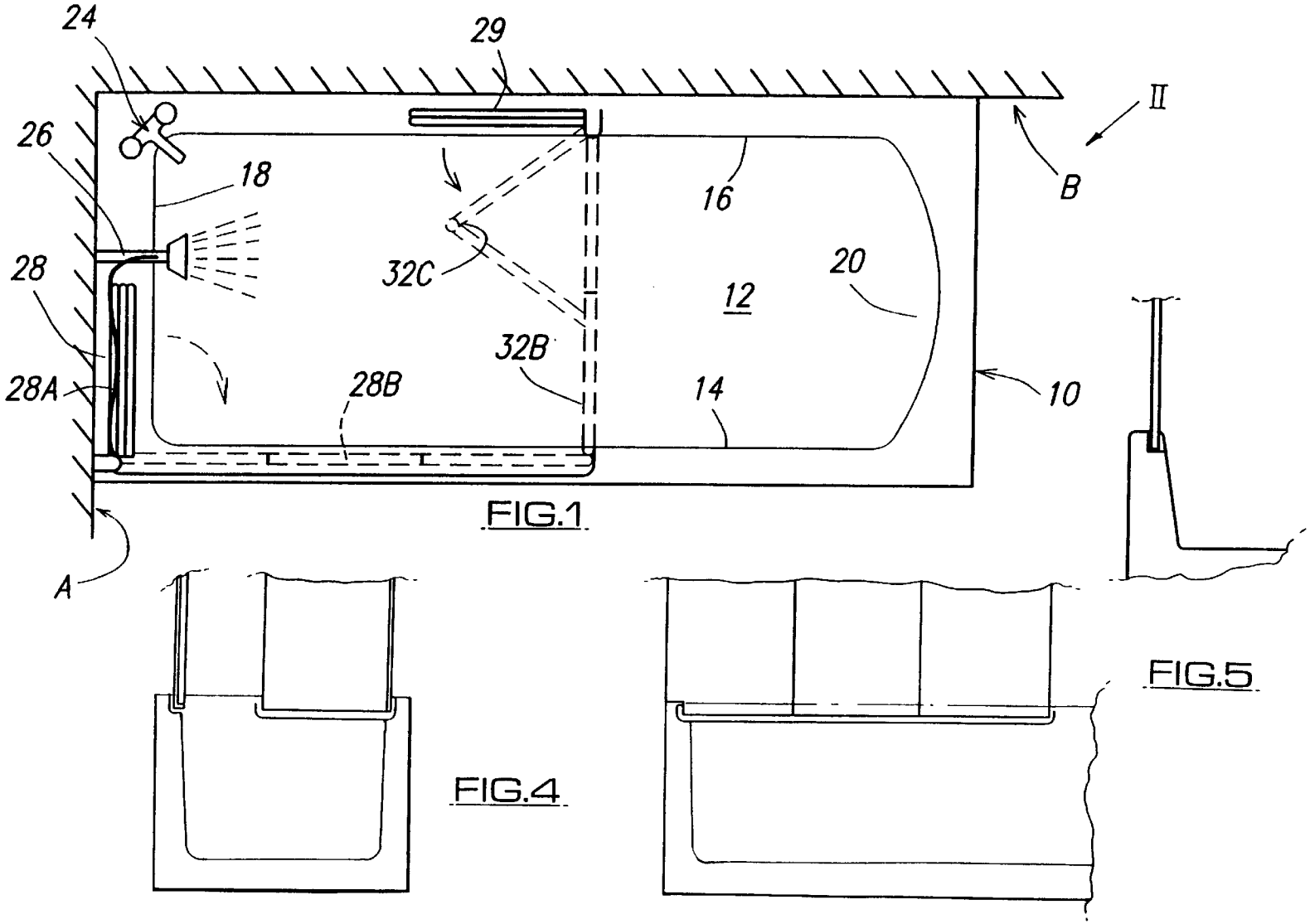
FIG. 1 is a plan view of a bath and shower assembly according to the embodiment of the invention.
FIGS. 4 and 5 are further sectional views from the end and side of the bath shown in FIG. 1.

Referring to the drawings, a bath 10 is fitted in the corner of a bathroom abutting end walls A and B respectively. The bath may be of any suitable construction, but typically may be of moulded plastics material as is widely used today.

The bath comprises a well 12 with sides 14, 16 and ends 18, 20, all of which lead to a top edge 22 surrounding the entire bath.

The hot and cold taps represented by assembly 24 are located at the corner of the bath adjacent the corner between walls A and B and access to the plumbing for the taps can be had along the underside of the top edge 22 adjacent end 18.

Reference numeral 26 represents a shower rose mounted above end 18 in conventional manner.

The bath thus far described is of conventional construction, but in accordance with the embodiment of this invention, the top edge is profiled in order to accommodate rigid shower panels. Two sets of panels are provided referenced 28 and 29 which in use extend vertically from the bath from the top edge thereof to the ceiling.

Panels 28 serve to provide a side screen for the bath at the free longer side, whilst the panels 29 serve to provide a transverse screen so as to form a shower cubicle above the bath.

The particular novel feature of the bath illustrated is the provision of rebates or recesses to accommodate the lower edges of the panels 28 and 29. By so arranging this construction, water which strikes the shower panels during showering will drain from the bottom edges and down into the bath, and not over the bath edge 22 and onto the bathroom floor or bathroom wall.

Figure 2:
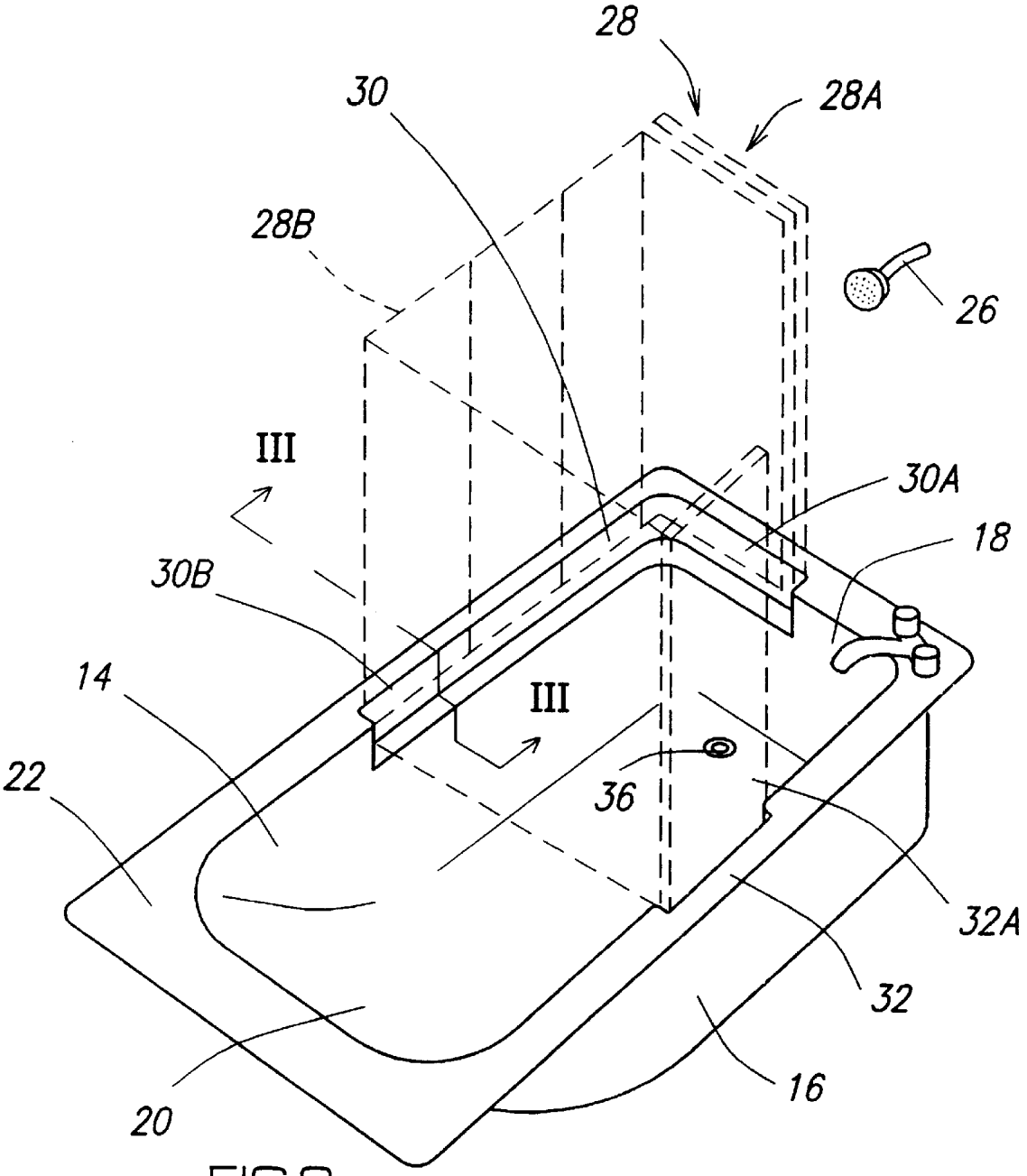
FIG. 2 is a perspective view of the arrangement of FIG. 1 looking in the direction of arrow II in FIG. 1.

In order to explain the provision of the recesses, reference is best made to FIG. 2 wherein it is shown that a first L-shaped recess 30 extends partway along the top edge 22 at end 18, as indicated by 30A, and partway along the top edge 22 at side 14 as indicated by 30B.

The panels 28 comprise in this example three in number, and they are joined by any suitable means such as pivot connections so as to be capable of being stacked concertina fashion as shown at 28A in FIG. 2 and in FIG. 1, but the panels can be opened out in order to lie co-planer or substantially so along the length of the recess 30B as shown in dotted lines in FIGS. 1 and 2 by reference 28B, by chain dotted lines in FIG. 2 by the same reference.

Equally, the panels 29 can be swung from the stored position in which they seat in a recess 32 in the middle of the top edge 22 at side 16, as indicated by reference 32A, and can be moved to a transverse position as indicated by 32B in which the two panels of the assembly 29 lie co-planer, and the outer lower most corner engages in the end of the recess 30B. The two panels 29 lock in the position 32B, so that they cannot be pushed rearwardly of the bath towards the rear end 20 when the panels are in use. They may typically be hinged as shown at 32C in FIG. 1 so as to be capable of being swung from the stored position in which they are parallel to wall B, to the in-use position in which they extend at right angles to the wall B and form a rear partition for the shower cubicle.

The panels 28 and 29 may be mounted on the adjacent walls A and B by any suitable method, and it is intended that pivot mounting on the walls A and B will be all that is required.

Figure 3:
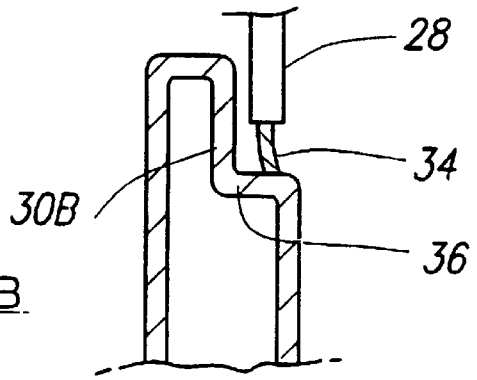
FIG. 3 is a sectional elevation taken on the line III—III in FIG. 2.

As shown in FIG. 3, lower edges of the panels 28 are provided with rubber or similar seals 34 which seat frictionally on the shoulder 36 of the recess 30B in order to provide a water seal.

It will be understood that an extremely simple and effective means is provided for ensuring that a shower cubicle can be created above a bath which has its lower edge extremely watertight as far as leakage onto the bathroom floor is concerned.

It will furthermore be appreciated that any number of screen panels may be adopted for either the side or transverse screens, and in some instances a transverse screen may not be required.

It will also be understood that the bath will require to be designed for right or left hand operation, and the recessing will be provided accordingly. The taps can be positioned in any appropriate location. Thus, the bath could be designed for use in either hand, and the tap holes then provided when a decision is made on whether the bath is to be a right hand or a left hand bath.

The invention can be applied in baths which are other than the conventional rectangular shape shown, as the various panels of the screens can be arranged to lie so as generally to follow the curvature of the bath sides.

It is a feature of the present invention that by virtue of the overhang as shown in the drawings, and in the alternative embodiments, the panels cannot be pushed outwardly at their lower edges beyond the top edge of the bath when they serve their screening function. The transverse panel when provided is also adapted in the embodiment shown to lock in the position 32B shown in FIG. 1 so that it cannot be folded or pushed rearwardly towards end 20 of the bath.

Such a shower cubicle has particular advantage when the shower rose 26 is supplied with mains water under pressure, because with these so-called pressurized showers, the spray of water issues with much greater power and velocity and more effective screening is obviously necessary in order to contain the water so that it will drain completely into the bath well 12 and out through the bath drain hole 36.

There may be temporary fixing devices for holding the panels in the operational position, and where the ends of the panels 28 and 29 meet in the end of recess 30B, there may be a clasp or other fixing device to hold them relative to each other whilst showering is taking place. Any other temporary fixing and holding devices may be adopted.

I claim:

1. A bath and shower screen assembly wherein said bath comprises opposite end sides and a front side having a substantially planar top edge which extends between said end sides, and wherein the shower screen comprises at least one front panel having a bottom edge, said screen being pivotally mounted relative to the bath so that the screen can be swung from an in use position in which it extends above the top edge of the front side of the bath, is prevented from being swung outwardly over the front side of the bath and it prevents water from a shower from spilling over said front side of the bath, and a stowed position in which the screen is clear of said front side, and wherein the top edge of the front side of the bath is stepped to define a shoulder, characterized in that the shoulder is so engaged by the bottom edge of the screen to hold the screen in the in use position.

2. An assembly according to claim 1, characterized in that the bottom edge of the panel is provided with sealing strip means which engages the shoulder.

3. An assembly according to claim 1, wherein there are several of said front panels which are hinged together.

4. An assembly according to claim 1, characterized by at least one side panel which lies transverse to the bath and extends across the bath and forms with the front panel a shower cubicle over the bath.

5. An assembly according to claim 4, characterized in that the side panel is hinged to an adjacent bathroom wall and has a free edge which seats on the said shoulder.

6. An assembly according to claim 4, characterized in that there are several side panels hinged together so as to be foldable away to a stowed position in which the side panels lie parallel to an adjacent wall.

7. An assembly according to claim 1, characterized in that the front screen panel is hinged to a wall adjacent the bath.

* * * * *

UNITED STATES PATENT AND TRADEMARK OFFICE

CERTIFICATE OF CORRECTION

PATENT NO. : 5,845,344

DATED : December 8, 1998

INVENTOR(S) : Lenighan, Jeremy David

It is certified that error appears in the above-identified patent and that said Letters Patent is hereby corrected as shown below:

In claim 1 (column 5), line 7, cancel "substantially planar"; line 8 after "end sides", insert -- and which is substantially planar at least along a portion thereof --; line 11, replace "it" with -- the screen -- and replace "above" with -- over said substantially planar portion of --; line 13, replace "it" with -- the screen --.

Signed and Sealed this

Seventh Day of March, 2000

*Attest:*

*Attesting Officer*

Q. TODD DICKINSON

*Commissioner of Patents and Trademarks*